US005080819A

United States Patent [19]

Morganson et al.

[11] Patent Number: 5,080,819

[45] Date of Patent: Jan. 14, 1992

[54] LOW TEMPERATURE CAST DETERGENT-CONTAINING ARTICLE AND METHOD OF MAKING AND USING

[75] Inventors: Stephen A. Morganson, Eagan; Bernard J. Heile, Apple Valley; Kim J. Ashton, Vadnais Heights, all of Minn.

[73] Assignee: Ecolab Inc., St. Paul, Minn.

[21] Appl. No.: 410,012

[22] Filed: Sep. 18, 1989

Related U.S. Application Data

[63] Continuation of Ser. No. 200,067, May 27, 1988, abandoned.

[51] Int. Cl.[5] ..... C11D 7/06; C11D 7/16

[52] U.S. Cl. ..... 252/90; 252/135; 252/156; 252/174; 252/174.21; 252/174.24; 252/DIG. 16

[58] Field of Search ..... 252/90, 135, 156, 174, 252/174.21, 174.24, DIG. 16

[56] References Cited

U.S. PATENT DOCUMENTS

| | | | |
|---|---|---|---|
| 3,048,548 | 8/1962 | Martin et al. | 252/135 |
| 3,166,513 | 1/1965 | Minzuno et al. | 252/99 |
| 3,334,147 | 8/1967 | Brunelle et al. | 252/156 |
| 3,444,242 | 5/1969 | Rue et al. | 252/174.21 |
| 3,535,258 | 10/1970 | Sabatelli et al. | 252/105 |
| 3,579,455 | 5/1971 | Sabatelli et al. | 252/135 |
| 3,936,386 | 2/1976 | Corliss et al. | 252/99 |
| 4,725,376 | 2/1988 | Copeland | 252/90 |
| 4,753,755 | 6/1988 | Gansser | 252/90 |

FOREIGN PATENT DOCUMENTS

| | | |
|---|---|---|
| 003769 | 2/1978 | European Pat. Off. . |
| 2062465 | 12/1970 | Fed. Rep. of Germany . |
| 203523 | 5/1985 | Fed. Rep. of Germany . |

*Primary Examiner*—Hoa Van Le

*Attorney, Agent, or Firm*—Merchant, Gould, Smith, Edell, Welter & Schmidt

[57] ABSTRACT

A solid cast warewashing composition is produced for use in automatic washing machines at low temperatures. A liquid detergent composition is cast into a mold where it is allowed to solidify. The solid cast detergent, surrounded on all but its upper surface by the mold, is used in automatic washing machines having a dispensing device designed to dispense a liquid aqueous detergent formed from the solid cast detergent using an impinging liquid spray. The liquid aqueous detergent flows out of the dispensing device generally simultaneously with its formation in the dispenser. The cast detergent composition includes about 5 to 12 wt-% of a nonionic surfactant, an alkali metal hydroxide, a sequestrant, water of hydration and optionally further includes one or more preformed cores or plugs comprising an available chlorine source, a defoamer, or the like.

7 Claims, No Drawings

LOW TEMPERATURE CAST DETERGENT-CONTAINING ARTICLE AND METHOD OF MAKING AND USING

This is a continuation of application Ser. No. 07/200,067, filed May 27, 1988, now abandoned.

FIELD OF THE INVENTION

This invention relates to a novel solid cast detergent containing article which is particularly useful at low water temperatures in institutional dishwashing machines and industrial washing machines. Another aspect of this invention relates to a method for producing the detergent-containing article. Another aspect of this invention relates to a method for using the detergent containing article.

BACKGROUND OF THE INVENTION

Solid cast high performance detergent-containing articles which can be used in institutional dishwashing machines and industrial washing machines at high water temperatures are known in the art. The advent of such high performance products was stimulated in part by increased aesthetic and sanitary standards and a demand for shorter wash times. Such high performance products are generally complex detergent compositions which are hazardous to the user. High performance solid detergents generally possess a high alkalinity (e.g., greater concentrations of sodium hydroxide)--higher even to the point of posing safety hazards to the user.

High temperature, high performance solid cast detergent compositions typically contain high concentrations of alkali metal hydroxides. In addition to alkali metal hydroxides (e.g., sodium hydroxide), chemicals used in high temperature, high performance products, particularly for hard surface cleaning (e.g., warewashing) include phosphates, silicates, chlorine-containing compounds, defoamers and organic polyelectrolyte polymers. See U.S. Pat. No. 3,166,513, issued Jan. 19, 1965 (Mizuno et al); U.S. Pat. No. 3,535,285, issued Oct. 20, 1970 (Sabatelli et al); U.S. Pat. No. 3,579,455, used May 18, 1971 (Sabatelli et al); U.S. Pat. No. 3,700,599, issued Oct. 24, 1972 (Mizuno et al); and U.S. Pat. No. 3,899,436, issued Aug. 12, 1975 (Copeland et al). The alkali metal hydroxides in these compositions are very effective in removing most stubborn food soils, but a source of available chlorine is usually included to control food stains, such as tea and coffee stains. The defoamer is usually included to control foam created by a proteinaceous soil and saponified fats. The use of chlorinated cyanuarates as a source of available chlorine in detergents used to clean hard surfaces is disclosed in U.S. Pat. No. 3,166,513, issued Jan. 19, 1965 (Mizuno et al); U.S. Pat. No. 3,933,670, issued Jan. 20, 1976 (Brill et al); U.S. Pat. No. 3,936, 386, issued Feb. 3, 1976 (Corliss et al).

A problem of these high temperature, high performance solid cast detergent-containing articles, however, in addition to their high alkalinity which poses hazards to users, is their reduced effectiveness at low water temperatures. The high alkaline compositions of the prior art, while effective at high water temperatures, typically experience a reduced effectiveness at water temperatures below about 140° F., necessitating the use of a large amount of detergent composition in order to obtain satisfactory cleaning results.

At high water temperatures, sodium hydroxide will effectively solubilize protein and saponify fats. At low water temperatures, however, the cleaning power of sodium hydroxide can be reduced depending on soil load and type.

A need therefore exists for a solid cast detergent composition which is effective at water temperatures below about 140° F. which minimizes hazards to the user, and which does not require a large product usage level.

SUMMARY OF THE INVENTION

It has now been found that the high alkaline safety problems and cold water performance problems described above can be minimized by forming a solid cast detergent in a disposable mold and dispensing or using the detergent directly from the mold/cast detergent combination wherein the cast detergent composition comprises an alkali metal hydroxide, at least about 4 wt % of a nonionic surfactant, a hardness sequestering agent and water of hydration. The combination of the cast detergent and the disposable mold in which it was formed provides an article of commerce capable of dispensing dissolved solids from substantially only one side of the surface which was the free or unsupported surface in the mold. Alternatively, the solid cast detergent composition can be removed from the mold in which it is formed prior to use.

Thus, the present invention relates to a low temperature solid cast three-dimensional, detergent composition comprising an alkali metal hydroxide, at least about 4 wt % of a nonionic surfactant, a hardness sequestering agent, and water of hydration. The invention can further comprise a receptacle-shaped mold surrounding and containing the detergent composition on all but one surface.

The detergent composition is normally formed by mixing and heating the components in an aqueous solution, thickening the solution, pouring the solution into the mold and preferably also cooling it, and allowing the mixture to solidify, it being understood that the solidification can involve one or more physico-chemical mechanisms, including "freezing", precipitation from solution, hydration, etc. Preformed plugs or cores of a chlorine source and/or a defoamer can be inserted in the mixture after it has been added to a mold and before it has solidified.

The cast detergent composition is preferably left in the disposable mold in which it was cast. Alternatively, the cast detergent can be demolded and inserted in an inexpensive container or receptacle which has substantially the same configuration as the mold, since in either case the cast detergent is surrounded on all but one surface, as described previously. The thus-surrounded cast detergent is used by placing its exposed surface in a drainable position (preferably fixed) within a detergent dispensing apparatus. A fixed drainable position is one in which the aforementioned unsurrounded, exposed surface is fixed with respect to the horizontal and a potential impinging spray of liquid such that the unsurrounded, exposed surface permits gravity flow therefrom, either because of an inclination from the horizontal by degrees (e.g., by 10°-90°) or by inclination beyond 90° , i.e., partial or total inversion up to and including a totally inverted or downward-facing position. A spray of liquid impinging on the drainable (inclined or inverted) surface, suitably controlled in duration, provides a draining action or gravity flow of liquid detergent which drains downward off of the drainable surface to the washing machine into which the detergent is to be dispensed. Control over the duration of impingement (hence the duration of downward flow) has the effect of controlling the concentration of detergent in the washing machine. The dispensing apparatus is not a water-in-reservoir type, since it dispenses the flow of liquid detergent about as fast as this flow is formed by the spraying action.

One necessary component for producing the low temperature solid cast detergent composition of the present invention is an alkali metal hydroxide. Suitable alkali metal hydroxides include but are not limited to the following: sodium hydroxide and potassium hydroxide. Preferably the low temperature solid cast detergent composition comprises sodium hydroxide for economic reasons.

The alkali metal hydroxide will normally comprise about 10 to 60 wt % of the detergent composition for reasons of chemical soil removal, preferably 20 to 50 wt % for reasons of more cost effective soil removal, and most preferably about 35 to 50 wt % for reasons of most cost effective soil removal. If the alkali metal hydroxide concentration is too low chemical soil removal performance will deteriorate. If the alkali metal hydroxide concentration is too high an increase in use cost will result.

The alkali metal hydroxide serves the following function in the low temperature solid cast detergent composition chemical soil removal.

A second necessary component of the low temperature solid cast composition of this invention is water. Water is used in combination with alkali metal hydroxide to form a meltable carrier medium containing the detergent components; the medium being cast into a mold and solidified by a solidification mechanism described previously. Water may be added as a separate ingredient or in combination with one of the other components, for example as an aqueous solution of 50% sodium hydroxide.

The water of hydration will normally comprise about 5 to 30 wt % of the detergent composition, preferably about 10 to 20 wt % for reasons of keeping the mixture fluid and processable at a temperature ranging from about 155–180° F. and most preferably about 12 to 15 wt % for reasons of keeping the mixture fluid and processable at a temperature ranging from about 155–180° F.

A third necessary component of the low temperature solid cast detergent composition of this invention is a nonionic surfactant. It has been found that at low water temperatures, the cleaning power of alkali metal hydroxide can be reduced depending upon soil load and type. To obtain desired low temperature cleaning results a nonionic surfactant is added to augment the cleaning action of the alkali metal hydroxide. The nonionic surfactant serves to emulsify fats rather than saponify them. The nonionic surfactant used must be compatible with the alkali metal hydroxide and must be low foaming. Useful nonionic surfactants include, but are not limited to, the following: the surfactants disclosed in U.S. Pat. No. 3,444,242, issued May 13, 1969 (Rue et al) which is hereby incorporated by reference. Additional nonionic surfactants which can be used in the low temperature solid cast detergent composition of the present invention include, but are not limited to, the following: ethylene oxide-propylene oxide block copolymer such as Triton CF54 available from Rohm & Haas, Plurafac RA-U3 available from Wyandotte, Pluronic L62 available from Wyandotte, Triton CF 10 available from Rohm & Haas, and Pluronic L61 available from Wyandotte.

The nonionic surfactant is typically included within the solid cast detergent composition itself rather than in a plug or core for reasons of ease and manufacturing simplicity.

The low temperature solid cast warewashing composition of the present invention should comprise about 2 to 10 wt % of a nonionic surfactant for reasons of fatty soil emulsification, preferably about 5 to 9 wt % for reasons of optimum fatty soil emulsification, and most preferably about 4 to 8 wt % for reasons of most optimum soil emulsification.

The detergent composition must contain a sufficient amount of nonionic surfactant such that the detergent composition is effective at low water temperatures at water temperatures ranging from about 100° to 160° F., preferably about 120° to 140° F. for reasons of cost performance efficiency.

The nonionic surfactant must be added at such an unconventionally high level in order to obtain effective performance at low water temperatures.

A fourth necessary component of the low temperature solid cast detergent composition is a sequestrant. The low temperature solid cast warewashing composition of the present invention should comprise about 16 to 50 wt % of sequestrant, preferably about 15 to 34 wt % for reasons of cost performance legal restrictions, and most preferably about 20 to 30 wt % for reasons of optimum cost performance.

The service water commonly employed in cleaning baths contain substantial proportions of hardness ions most commonly calcium and magnesium ions, which can react with detergent components to decrease cleansing effectiveness and/or leave unsightly deposits upon the substrate being cleaned. Sequestrants act to prevent or delay crystal growth of calcium or magnesium compounds and thereby eliminate their reaction with other components and/or their precipitation.

Suitable sequestrants for use in the low temperature solid cast detergent composition of the present invention include but are not limited to the following: phosphates, particularly phosphates of the formula $M—(PO_3M)_nOM$ wherein M is an alkali metal and n is a number ranging from 1 to about 60, typically less than 3 for cyclic phosphates, typical examples of such phosphates being sodium or potassium orthophosphate and alkaline condensed phosphates (i.e., polyphosphates) such as sodium or potassium pyrophosphate, sodium tripolyphosphate, sodium hexametaphosphate, etc.

Preferably the sequestrant comprises sodium tripolyphosphate for reasons of sequestration, peptizing, and soil suspension.

Preferably the sequestrant is utilized in its anhydrous form for reasons of cost. However, a sequestrant in its hydrated form could be utilized if the water content of the other raw materials is adjusted downward to compensate for the water of hydration contained in the sequestrant.

In addition to those components previously described, other conventional detergent components and fillers can be included. For example, it is possible to include a defoamer.

Defoamers, in addition to the above mentioned nonionic surfactants, can also be included in the low temperature solid cast detergent composition. Defoamers will normally comprise minor amounts of the low temperature solid cast detergent composition, i.e. about 0.1 to 5 wt %, for reasons of cost performance, preferably about 0.1 to 2.0 wt % for reasons of optimum cost performance, and most preferably about 0.2 to 0.5 wt % for reasons of most optimum cost performance. Typically, a "defoamer" is a chemical compound with a hydrophobe/-hydrophile balance suitable to reducing the stability of protein foam. The hydrophobicity can be provided by an oleophilic portion of the molecule (e.g., an aromatic alkyl or aralkyl group; an oxypropylene unit or oxypropylene chain, or other oxyalkylene functional groups other than oxyethylene, e.g., tetramethylene oxide). The hydophilicity can be provided with oxyethylene units or chains or blocks and/or ester groups (e.g., organophosphate esters), salt-type groups, or salt-forming groups. Typically, defoamers are nonionic organic surface-active polymers having hydrophobic groups or blocks or chains and hydrophilic ester groups, blocks, units, or chains, but anionic, cationic, and amphoteric defoamers are known. For a disclosure of nonionic defoaming surfactants, see U.S. Pat. No. 3,048,548, issued Aug. 7, 1962 (Martin et al), U.S. Pat. No. 3,334,147, issued Aug. 1, 1967 (Brunelle et al), and U.S. Pat. No. 3,444,242, issued May 13, 1969 (Rue et al). Phosphate esters are also suitable, e.g., esters of the formula $RO—(PO_3M)—_nR$, wherein n is as defined previously and R is an organic group or M (as defined previously), at least R being an organic group such as an oxyalkylene chain.

The low temperature solid cast detergent composition can optionally further comprise about 1 to 20 wt % of hydratable, crystalline alkali metal silicate for reasons of soil suspension, and providing alkalinity and corrosion protection, preferably about 10 to 20 wt % for reasons of providing optimum soil suspension, providing additional alkalinity and corrosion protection and most preferably about 12 to 18 wt % for reasons of providing most optimum soil suspension, providing additional alkalinity and corrosion protection.

Alkali metal silicates are the reaction product of an alkali metal oxide ($M_2O$) and silicone dioxide ($SiO_2$) and have the general chemical formula $(M_2O)_x:(SiO_2)_y$ wherein x and y indicate the molar ratio of alkali metal oxide to silicone dioxide.

Methods of manufacturing alkali metal silicates having various x:y mole ratios are well known as demonstrated by the general disclosure in Kirk-Othmer Encyclopedia of Chemical Technology, 2d Ed., Vol. 18, pp. 139-141. The desired properties and benefits of the low temperature solid cast detergent composition described herein can be obtained by using an alklai metal silicate having an x:y ratio of about 1:1 - 3:1, preferably 1:1. At these ratios, the alkali metal silicate has sufficient alkaline character to clean effectively and sufficient silicone dioxide to protect aluminum, china, glassware, etc. from the etchant effect of basic components in the composition. These silicates also have excellent solidification properties.

For reasons of high cleaning performance, delicate ware protection and low cost, the most preferred alkali metal silicate is sodium metasilicate having an $Na_2O$:-$SiO_2$ ratio of about 1:1. Preferably anhydrous alkali metal silicate is utilized to minimize water content in the final product and optimize use cost by concentrating the product.

The low temperature solid cast detergent composition can optionally further comprise a carbonate such as sodium carbonate and potassium carbonate. Carbonates can comprise about 0 to 30 wt % of the detergent composition for reasons of water hydration followed by solidification, preferably about 15 to 25 wt % for reasons of cost optimization, and most preferably about 15 to 20 wt % for reasons of optimum cost optimization.

Carbonates serve the following function in the low temperature solid cast detergent composition of the present invention. They hydrate water and solidify the product in its container. The low temperature solid cast detergent composition can optionally further comprise a dye. Dyes can comprise about 0.0 to 0.2 wt % of detergent composition, preferably about 0.0 to 0.1 wt % for reasons of cost and desired hue, most preferably about 0.005 to 0.05 wt % for reasons of optimum cost and desired hue.

The low temperature solid cast detergent composition can optionally further comprise about 0 to 5 wt % of a salt such as sodium chloride and/or sodium sulfate for purposes of a filler. Typically, four component compositions of the low temperature solid cast detergent composition of this invention can be formulated from (1) at least about 4% of a low foaming nonionic surfactant, (2) a phosphate or other hardness-precipitating or hardness sequestering agent, (3) an alkali metal hydroxide, and (4) water. Typically, five or six component compositions would further include a defoamer and/or a neutral inorganic salt (alkali metal halides, sulfates, etc.) and/or a thickening agent, thixotrope, suspending agent or organic chelating or sequestering agent, or the like.

Typically, the low temperature solid cast detergent composition of this invention employs a condensed alkali metal phosphate for the sequestering of hardness ($Mg^{++}$and $Ca^{++}$ions). However, organic chelating or sequestering agents (citric acid, polyelectrolytes such as the polyacrylates of molecular weight 1000-3000 etc.) have been used as alternatives to or in combination with the condensed phosphates; see, for example U.S. Pat. No. 3,535,258, issued Oct. 20, 1970 (Sabatelli et al), U.S. Pat. No. 3,579,455, issued May 18, 1971 (Sabatelli et al), U.S. Pat. No. 3,700,599, issued Oct. 24, 1972 (Mizuno et al), and U.S. Pat. No. 3,899,436, issued Aug. 12, 1975 (Copeland et al). As is known in the art, polyacrylates (particularly alkali metal salts of polyacrylic acid and its copolymers) can function as thickeners in aqueous systems. Cast detergent compositions of this invention can contain about 0 to 10 wt % by weight of polyelectrolytes, as the sole sequestering agent or in combination with alkali metal condensed phosphates, preferably about 2 to 7 wt % for reasons of viscosity, processing and cost performance, and most preferably about 3 to 5 wt % for reasons of optimum viscosity, processing and cost performance.

Preferably, sodium polyacrylate is used as the organic sequestering agent for viscosity control in the process and hardness sequestration. Sodium polyacrylate helps prevent a phosphate sequestrant from settling out during the process.

The article of the invention can also comprise a disposable container or mold into which the detergent composition is cast or allowed to solidify. During shipping, the article will normally include a lid or cover. The lid or cover can be made of the same or similar material as used to make the mold. As will be explained subsequently, this material is ordinarily alkaline resistant, nonbreakable, and inexpensive. Expensive corrosion-resistant metals or plastics can be used, if provision can be made for their recycling, but "disposable" materials would normally be preferred for most institutional uses. The low temperature solid cast detergent composition is typically surrounded by and in contact with the mold on all but the upper surface of the solid cast detergent. A cross-section of the solid cast detergent can be more than a centimeter thick (e.g., 2–20 cm thick). The area of the upper surface can easily exceed 100 $cm_2$, e.g., 125 $cm_2$ to 1000 $cm_2$ or more. Unlike compressed detergent tablets, it has been found that cast detergent blocks can be made very large--almost any desired size.

The mold or container can be made of any alkali-resistant material which can withstand moderately elevated temperatures, e.g., 150° F., and which can be formed into and hold the desired shape. Since the mold is generally intended to be "disposable" (i.e., not intended for reuse as a mold), inexpensive materials are preferred such as thermoplastics, resin-impregnated heavy paper or cardboard, and the like. Inexpensive but fragile material such as glass or ceramics are less preferred due to handling or shipping problems, relatively flexible materials being preferred. Molds are made of plastic (e.g., inexpensive thermoplastics) have been found to be particularly useful.

The low temperature solid cast detergent-containing article can be used in conjunction with a detergent dispensing apparatus which can be part of a conventional institutional or industrial washing machine. The article, including base detergent and container is placed in a totally downward-facing or totally inverted position over a spray means which is connected to a water source, whereby the exposed surface of detergent becomes a drainable surface. When the water source is turned on, the spray means causes water to impinge on the exposed surface of detergent. The detergent dissolves, creating a gravity flow of liquid aqueous detergent which flows downwardly through a pipe to a wash tank or washing zone of the washing machine. The detergent composition can be formulated to dissolve at substantially the same rate and thus supply the tank with a consistent ratio of ingredients.

By controlling the spray time, the amount of detergent, and thereby the concentration of detergent in the wash can be controlled. In other words, the liquid aqueous detergent formed as a result of the impingement of the spray on the exposed surface of detergent flows by gravity into pipe generally simultaneously with its formation within a dispensing apparatus. Standing water of aqueous liquid is not permitted to accumulate within the dispensing apparatus.

METHOD OF MANUFACTURING CAST DETERGENT

The low temperature solid cast detergent composition of the present invention can be formed by a number of methods including but not limited to batch processing and semicontinuous processing.

While the following processes are described with reference to specific components, it should be understood that other components and similar processes can be used to form a detergent solution which can be cast into a mold and which will solidify upon hydration of its hydratable component to form a low temperature solid cast detergent composition. The low temperature solid cast detergent composition of this invention can be manufactured by combining the components in a suitable mixer having sufficient resistance to chemical attack from the ingredients and sufficient mixing capacity.

While the ingredients can be mixed generally in any order without substantially reduced properties, the preferred mode of preparing the composition is first charging to a large industrial scale mixer an aqueous solution of an alkali metal hydroxide. Mixing and heating the aqueous solution of alkali metal hydroxide result in a mixable fluid matrix. Into the aqueous solution in the industrial mixer can then be placed the balance of the components. If the sequestrant utilized contains phosphate it is preferably added near the end of the process in order to minimize phosphate reversion.

The industrial mixer is operated at a sufficient speed and horsepower and temperature range to insure adequate mixing of the components. Once the components are fully mixed and uniform, the composition is drawn off into molds or capsules for solidification.

During processing the components are preferably mixed and drawn off into the capsule or mold while maintaining the temperature of the composition at about 150° to 160° F. for reasons of keeping the product molten and thus processible, preferably about 153° to 157° F. for optimum processability. The process must be run at a minimum of about 150° throughout in order to maintain a molten product.

A particularly useful detergent composition of this invention is formed by heating about 60 to 70 parts by weight of a 40–75 weight percent aqueous solution of an alkali metal hydroxide, e.g., sodium hydroxide, to a temperature of about 150–165° F., preferably about 154° to 157° F. for reasons of optimum processing. See Examples 1–4 which follow. This temperature range is critical to final product viscosity and quality since it allows mixing of the product while in its fluid state. Heating should then be discontinued after the temperature reaches the above listed range.

The alkali metal hydroxide solution is then mixed at a sufficient rate for effective heat distribution and in order to keep the solution mixed and flowing. While other alkali metal hydroxides may be used, sodium hydroxide has been found to be particularly useful and the following method of manufacturing will be described with respect to it. Aqueous solutions of 50 weight percent sodium hydroxide are readily commercially available. Solutions containing higher weight percents of sodium hydroxide are also available (e.g, 73%) or can be produced by adding a desired amount of anhydrous sodium hydroxide to a 50 weight percent solution of sodium hydroxide. An aqueous solution of sodium hydroxide can also be prepared by mixing water and anhydrous sodium hydroxide in the desired ratio.

0 to 4 wt % of water, preferably about 2 to 3 wt % should then be charged to the mix tank. The aqueous alkali metal hydroxide solution provides an aqueous carrier matrix in which all other components of the cast composition can be suspended or dissolved.

About 2 to 5 wt % of a thickening such as a low molecular weight polyacrylic acid can be added to the mix tank while mixing is continued and while the temperature of this mix tank contents is maintained between about 150° and 160° F.

The thickening agent typically comprises about 45 to 55 wt % water based upon the thickening agent composition. If the thickening agent does not comprise water the water content of the other components should be adjusted accordingly. The addition of the thickener to the aqueous alkali metal hydroxide solution results in a mixture in which the alkali metal hydroxide is hydrated and the polyacrylate thickener is used to maintain viscosity.

About 30 to 40 wt % of anhydrous sodium hydroxide beads, preferably about 35 to 40 wt % for reasons of establishing the proper matrix, and most preferably about 34 to 36 wt % are then added to the mix tank. The addition of the anhydrous sodium hydroxide beads brings up the concentration of sodium hydroxide in the mixture to its final level. With the addition of the anhydrous sodium hydroxide beads there is no longer any free water in solution resulting in a molten matrix.

About 0 to 5 wt % of a neutral inorganic salt such as anhydrous sodium chloride can then be added to the mix tank in order to promote viscosity.

Next, about 2 to 10 wt % of a nonionic surfactant such as a benzyl ether or a polyethoxylated linear alcohol is added to the mix tank. Mixing should occur for a sufficient amount of time in order to render the mix tank contents homogeneous. About 20 to 34 wt % of a sequestrant such as sodium tripolyphosphate can then be added to the mix tank. Alternatively, a sodium tripolyphosphate surfactant premix can be added at this time.

About 21 to 35 wt % of a sodium tripolyphosphate surfactant premix can then be added to the mix tank. The "sodium tripolyphosphate surfactant premix" is as defined in Example 1. Phosphate containing compositions are preferably added late in the process to minimize phosphate reversion.

About 0 to 0.05 wt % of a dye can then be added to the mix tank contents. The dye is typically added near the end of the process to protect the dye, but not so late that there is insufficient time for the dye to be adequately blended with the mix tank contents.

Optional ingredients are typically added to the mix tank after the nonionic surfactant is added but before the addition of the sequestrant.

After the sequestrant such as a polyphosphate and/or optional fillers or components (the polyphosphate is a preferred ingredient), are added, the mixture can be cooled. Continuous mixing can be used during any dissolving, cooling and thickening steps. The cooled and thickened mixture is poured into a receptacle-shaped mold to a level at least part way up the side molding surfaces. As the mixture continues to cool, it will solidify to form a cast composition. Solidification is believed to be substantially due to cooling. (This invention is not bound by any theory, however.) After it has solidified, the cast detergent is surrounded by and in contact with the mold on all sides except for its upper surface which remains exposed.

The present invention will be further understood by reference to the following specific Examples which are illustrative of the composition, form and method of producing the low temperature solid cast detergent-containing article of this invention. It is to be understood that many variations of composition, form and method of producing the cast detergent would be apparent to those skilled in the art. The following Examples, wherein parts and percentages are by weight unless otherwise indicated, are only illustrative.

EXAMPLE 1

A 10,000 pound batch of a low temperature solid cast detergent composition of this invention was prepared using the following procedure. The equipment utilized included a 1000 gallon stainless steel jacketed mix tank having a recirculation line, a positive displacement pump, a variable speed agitator, and a secondary mix tank.

6.997 wt % of a 50 wt % aqueous solution of sodium hydroxide was charged to the 1000 gallon mix tank. The variable speed agitator was then adjusted to the lowest level. The contents of the mix tank were then heated to a temperature range of 150–165° F. Heating was then discontinued at that point. 8.00 wt % of soft water was then charged to the mix tank. The agitation rate was then increased to 75 r.p.m. Recirculation of the mix tank contents was then begun.

The mix tank contents were then heated to a temperature range of 185–190° F. 2.000 wt % of a low molecular weight polyacrylic acid was added slowly to the mix tank at a rate of 25 pounds/minute. The addition of the polyacrylic acid resulted in an exothermic reaction which increased the temperature of the contents of the mix tank to a range of 220–230 ° F. The mix tank contents were then agitated for 15 minutes.

Next, 45.000 wt % of sodium hydroxide beads were slowly added to the mix tank. The agitation rate was then varied, but did not exceed 110 r.p.m. The contents of the mix tank were then cooled to 150–155 ° F., the agitation rate being decreased as necessary to prevent vortexing.

3.000 wt % of anhydrous sodium chloride was then added to the mix tank. Next, 0.003 wt % of pontamine red (a dye) was premixed with one gallon of water and added to the mix tank.

3.000 wt % of benzyl ether of a polyethoxylated linear alcohol was then added to the mix tank by pumping the nonionic surfactant below the surface of the mix tank contents. The agitation rate was then increased to 130 r.p.m. The mix tank contents were then cooled to 145–150° F.

1110 lbs of the mix tank contents were then transferred to the 150 gallon secondary mix tank. Agitation was then begun. The secondary mix tank temperature ranged from 143–150 ° F. 32.000 wt % of a sodium tripolyphosphate surfactant premix (described below) was then added to the 150 gallon secondary mix tank. The agitation rate was then increased as necessary to avoid lump formation. Agitation was continued 5 minutes after delumping. The agitation speed was then decreased to 90–100 r.p.m. The temperature was maintained in the range of 143–150° F.

Just before the start of packaging, continuous feeds of stock solution and sodium tripolyphosphate surfactant premix were added to the 150 gallon secondary mix tank.

The flow of stock solution was in the range of about 4 lb. 11 oz. per 5 seconds to 5 lbs. 3 oz. per 5 seconds. The flow of sodium tripolyphosphate surfactant premix was in the range of about 3 lbs. 5 oz. to 3 lbs 9 oz. in 10 seconds.

After the mixture had thickened but while it was still pourable, 8 pounds were poured into a receptacle-shaped mold consisting of a polyethylene container measuring about 9" in diameter and 6" high.

The product containing molds were capped and transmitted through a cooling tunnel water spray for a period of time of over an hour during which time the product hardened. The water spray utilized had a temperature of 60° F. and a pressure of 15 p.s.i.

The weight percentages of raw materials utilized in Example 1 were as follows:

| RAW MATERIAL | wt % In Formula |
|---|---|
| NaOH, 50% | 6.997 |
| Soft Water | 8.000 |
| Polyacrylic Acid (low m.w.) | 2.000 |
| Sodium Hydroxide Beads | 45.000 |
| Anhydrous Sodium Chloride | 3.000 |
| Pontamine Red (a dye) | .003 |
| Benzyl Ether of a Polyethozylated Linear Alcohol | 3.000 |
| Sodium Tripolyphosphate Surfactant Premix | 32.000 |
| | 100.000 |

While this product can be used as a detergent without additional additives, additional components can be included as previously described.

The sodium hydroxide 50%, utilized in the Examples, refers to an aqueous solution of 50 weight percent sodium hydroxide. Such solutions are readily commercially available.

The low molecular weight polyacrylic acid utilized in the Examples had the following properties:

| Properties | |
|---|---|
| Appearance: | Water white to amber hazy liquid |
| Activity: | 48-50% aqueous solution |
| Calcium Chelation: | 900-1100 meq. Ca |
| pH, 100% | 1.5-2.0 |
| Solubility: | Readily soluble in water at pH's greater than 4 |
| M.W. | —3000 (intrinsic viscosity) |
| Eq.Wt. | 72 |

The anhydrous sodium hydroxide beads utilized in the Examples had a size such that 80% of the beads could pass through a #60 U.S. mesh screen. Anhydrous sodium hydroxide bead are commercially available from a number of sources.

The benzyl ether of a polyethoxylated linear alcohol utilized in the Examples had the following properties:

| Properties | |
|---|---|
| Appearance: | Light amber solid |
| Activity: | 100% |
| Melting Point: | 30-35° C. |
| Cloud Point (1% solution): | 60-64° F. |
| Hydroxyl Value: | 5 max. |
| pH (1% solution): | 6.7-8.0 |
| Refractive Index @35° C.: | 1.4700-1.4725 |
| Surface Tension (0.1% solution): | 33.9 dynes/cm |
| Ross-Miles Foam (0.1% solution): | Initial: 5 mm<br>5 min.: 0 |

The sodium tripolyphosphate surfactant premix utilized in the Examples comprised 97.100% coarse granular sodium tripolyphosphate and 2.900% surfactant premix. The surfactant premix comprised 86.00% of an ethylene oxide/propylene oxide block nonionic terminated with propylene oxide having the following properties:

| Properties | |
|---|---|
| Appearance: | Amber liquid |
| Activity | 100% |
| Cloud Point (1% solution) | 85-90° F. |
| Hydroxyl value | 22-32 |
| pH (1% solution) | 9.5-10.7 |

-continued

| Properties | |
|---|---|
| Refractive Index @25° C. | 1.4570-1.4590 |
| Surface Tension (0.1% solution) | 42. |
| Specific gravity @25° C. | 1.037 |
| Density | 8.7 lbs/gal. |

and 14.00% of a defoamer which was a mixture of mono and dialkyl acid phosphate esters in which the alkyl groups were linear. The defoamer was rich in mono; the alkyl group being $C_{16}$.

The defoamer had the following properties:

| Properties: | |
|---|---|
| Appearance: | Tan Solid |
| Activity: | 100% |
| Melting Point: | 55-63° C. |
| pH (1% solution): | 2.3-3.2 |
| Solubility: | Completely soluble in mineral spirits, primary alcohols, aromatics, and many nonionic surfactants. Slightly soluble in water. |
| Typical Composition: | 6-9% Orthophosphate<br>57-64% Monoalkyl acid phosphate<br>7-11% Dialkyl acid phosphate<br>16-30% linear alcohol |

EXAMPLE 2

A solidified cast detergent was produced according to the method set forth in Example 1.

The weight percentages of raw materials utilized in Example 2 were as follows:

| Raw Material | % In Formula |
|---|---|
| NaOH, 50% | 11.997 |
| Soft Water | 2.000 |
| Polyacrylic Acid (low m.w.) | 7.000 |
| Sodium Hydroxide Beads | 40.000 |
| Anhydrous Sodium Chloride | 3.000 |
| Pontamine Red (a dye) | .003 |
| Benzyl Ether of a Polyethoxylated Linear Alcohol | 9.000 |
| Sodium Tripolyphosphate Surfactant Premix | 27.000 |
| | 100.000 |

EXAMPLE 3

A solidified cast detergent was produced according to the method set forth in Example 1.

The weight percentages of raw material utilized in Example 3 were as follows:

| Raw Material | % In Formula |
|---|---|
| NaOH, 50% | 16.997 |
| Soft Water | — |
| Polyacrylic Acid (low m.w.) | 10.000 |
| Sodium Hydroxide Beads | 35.000 |
| Anhydrous Sodium Chloride | 3.000 |
| Pontamine Red (a dye) | .003 |
| Benzyl Ether of a Polyethoxylated Linear Alcohol | 12.000 |
| Sodium Tripolyphosphate Surfactant Premix | 23.000 |
| | 100.000 |

EXAMPLE 4

A solidified cast detergent was produced according to the method set forth in Example 1.

The weight percentages of raw materials utilized in Example 4 were as follows:

| Raw Material | % In Formula |
|---|---|
| NaOH, 50% | 19.182 |
| Soft Water | 3.400 |
| Polyacrylic Acid (low m.w.) | 5.100 |
| Sodium Hydroxide Beads | 38.185 |
| Anhydrous Sodium Chloride | 3.000 |
| Pontamine Red (a dye) | .003 |
| Benzyl Ether of a Polyethoxylated Linear Alcohol | 5.130 |
| Sodium Tripolyphosphate Surfactant Premix | 26.000 |
| | 100.000 |

The above discussion, description, and Examples provides a sufficient basis to understand the invention.

While a variety of embodiments can be made without department from the spirit and scope of the invention, the invention resides in the claims hereinafter appended.

What is claimed is:

1. A solid cast warewashing detergent composition adapted for use in a low temperature warewashing machine at a temperature of less than about 160° F., which comprises:

(a) about 5 to 12 wt % of a nonionic surfactant capable of soil removal;

(b) about 10 to 60 wt % of an alkali metal hydroxide;

(c) about 10 to 50 wt % of a hardness-sequestering agent; and (d) about 5 to 30 wt % water of hydration; wherein each percentage is based upon the cast composition.

2. The cast composition of claim 1 which further comprises a receptacle-shaped disposable container surrounding said detergent composition on all but one surface thereof.

3. A cast composition according to claim 1, wherein said container is the mold in which said composition was cast and solidified.

4. A cast composition according to claim 3, which further comprises a cover attached to the said receptacle-shaped container.

5. A cast composition according to claim 1, wherein said composition additionally comprises a defoamer.

6. A solid cast warewashing detergent composition, adapted for use in a low temperature warewashing machine at a temperature of less than about 160° F., which comprises:

(a) about 5 to 8 wt % of a nonionic surfactant;

(b) about 20 to 50 wt % of an alkali metal hydroxide.

(c) about 15 to 34 wt % of a hardness-sequestering amount of an alkali metal condensed phosphate;

(d) about 10 to 20 wt % of water or hydration;

(e) about 2 to 7 wt % of a polyelectrolyte; and (f) up to about 1.0 wt % of a defoamer.

7. The solid cast composition according to claim 1, wherein said polyelectrolyte is sodium polyacrylate.

* * * * *